United States Patent [19]

Peterson

[11] 3,973,296

[45] Aug. 10, 1976

[54] METAL BUTTON ASSEMBLY

[75] Inventor: Richard J. Peterson, Paramus, N.J.

[73] Assignee: C & C Metal Products Corporation, Englewood, N.J.

[22] Filed: Jan. 28, 1975

[21] Appl. No.: 544,821

Related U.S. Application Data

[63] Continuation of Ser. No. 389,684, Aug. 20, 1973, abandoned, which is a continuation of Ser. No. 190,958, Oct. 20, 1971, abandoned.

[52] U.S. Cl. ..... 24/90 TA; 24/113 MP

[51] Int. Cl.[2] ..... A44B 1/18; A44B 1/12

[58] Field of Search ..... 24/90 R, 90 TA, 90 HA, 24/90 A, 113 MP

[56] References Cited

UNITED STATES PATENTS

| | | | |
|---|---|---|---|
| 305,620 | 9/1884 | Mayer | 24/90 A |
| 338,111 | 3/1886 | Smith | 24/113 MP |
| 1,316,012 | 9/1916 | Barron | 24/90 TA |
| 1,323,942 | 12/1919 | Wiener | 24/90 TA |
| 1,693,541 | 11/1928 | Batovec | 24/90 TA |
| 2,020,568 | 11/1935 | Oathout | 24/90 TA UX |
| 2,214,030 | 9/1940 | Pereles | 24/90 A X |
| 2,332,578 | 10/1943 | Kaynor et al. | 24/113 MP X |
| 3,154,036 | 10/1964 | Fimmel | 24/90 HA |

FOREIGN PATENTS OR APPLICATIONS

| | | | |
|---|---|---|---|
| 738,151 | 7/1966 | Canada | 24/90 R |
| 1,177,389 | 9/1964 | Germany | 24/90 R |
| 2,109,160 | 9/1971 | Germany | 24/90 R |
| 554,552 | 7/1943 | United Kingdom | 24/113 MP |

*Primary Examiner*—Donald A. Griffin
*Attorney, Agent, or Firm*—Shenier & O'Connor

[57] ABSTRACT

An improved metal button assembly adapted to be attached to a fabric by an automatic sewing machine without producing a pucker in the fabric in which a stamped sheet metal shell is formed with thread-receiving holes and with a peripheral flange for retaining an unperforated plastic blank swaged into the shell, the blank being formed with a central area of reduced thickness which is pierced by the sewing needle in the course of attaching the button to the garment, the blank having an undersurface lying generally in the plane of the flange edge and being sufficiently rigid to avoid puckering of the fabric.

3 Claims, 8 Drawing Figures

Fig 1
PRIOR ART
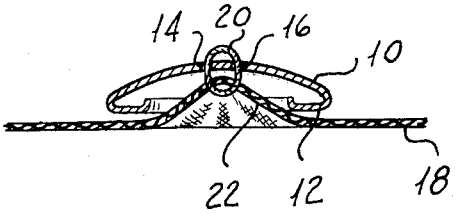
Fig 2
PRIOR ART
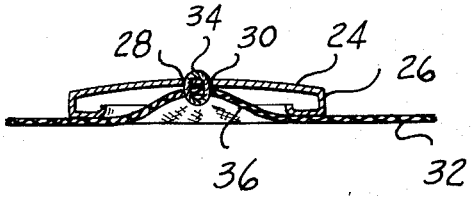
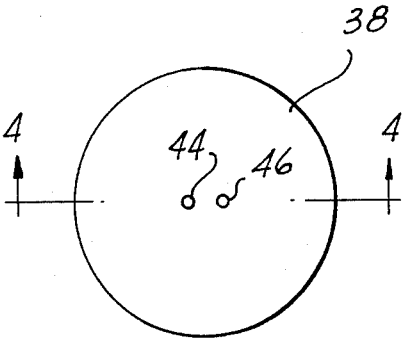
Fig 3
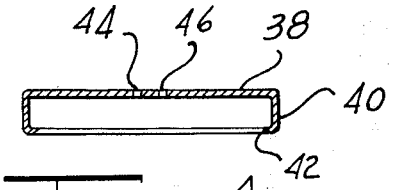
Fig 4
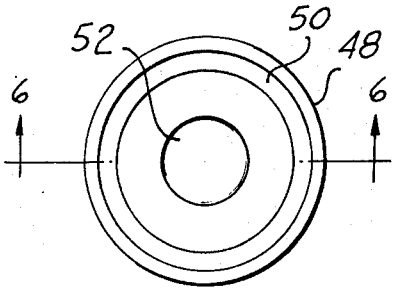
Fig 5
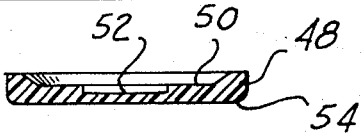
Fig 6
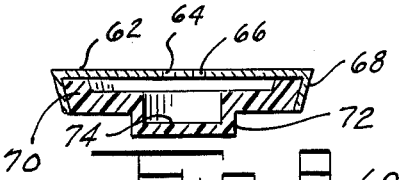
Fig 8
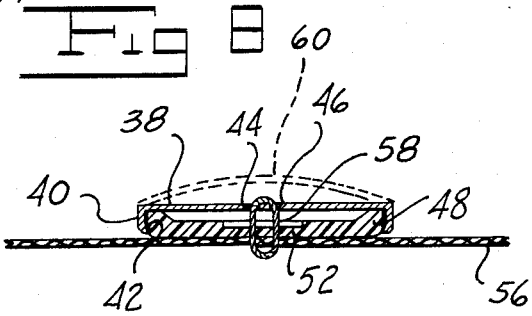
Fig 7
INVENTOR.
Richard J. Peterson
BY
Shenier & O'Connor
ATTORNEYS

METAL BUTTON ASSEMBLY

This is a continuation of application Ser. No. 389,684 filed Aug. 20, 1973, now abandoned which is a continuation of application Ser. No. 190,958, filed Oct. 20, 1971, now abandoned.

BACKGROUND OF THE INVENTION

Metal buttons are widely used in the garment industry. In order that the metal buttons of one manufacturer be competitive with those of other manufacturers, the buttons customarily are stamped as shells out of sheet metal and provided with thread-receiving holes. A peripheral lip or flange on the shell gives the button thickness and a degree of rigidity. In many instances, the outer surface of the button is convex. In most instances, however, because of puckering of the material, they are made flat or concave in an attempt to minimize the puckering.

While metal buttons can be inexpensively produced in the manner described above, when they are attached to the fabric of a garment by an automatic sewing machine the thread is tightly drawn around and into engagement with the edges of the holes in the shell. As a result the fabric is drawn up into the shell producing an unsightly pucker. In addition, the engagement of the thread with the sharp edges of the hole may result in undue wear on the thread and possible loss of the button.

Some attempts have been made in the prior art to solve the problem outlined above. Perhaps the most significant of these is the manufacture of a two-part metal button comprising an upper shell provided with thread-receiving holes and an under shell provided with thread-receiving holes and adapted to be assembled with the upper shell to form a button. Not only is the required stamping of two metal parts a relatively expensive procedure for the manufacture of an inexpensive article, but also the fact that the upper and lower sets of thread-receiving holes must be brought into registry during assembly makes that operation relatively difficult. Owing to these facts, and particularly in regions where labor costs are relatively high, buttons made by this process are so expensive as not to be competitive with other metal buttons.

I have invented an improved metal button assembly which overcomes the problem of puckering when the button is attached to a fabric. My button not only accomplishes this object, but is competitive with metal buttons of the prior art. It is relatively inexpensive to manufacture for the result achieved thereby.

SUMMARY OF THE INVENTION

One object of my invention is to provide an improved metal button assembly which overcomes the defects of metal buttons of the prior art.

Another object of my invention is to provide a metal button assembly which avoids puckering incident to the operation of attaching the button to a fabric.

A further object of my invention is to provide a metal button which reduces wear on the thread securing the button to a fabric.

A still further object of my invention is to provide an improved metal button assembly which overcomes the problem of metal buttons of the prior art while being competitive therewith.

A still further object of my invention is to provide a metal button assembly which is relatively inexpensive to produce.

Other and further objects of my invention will appear from the following description.

In general, my invention contemplates the provision of a metal button assembly comprising a sheet metal shell formed with generally centrally located thread-receiving holes and with a peripheral flange for retaining a plastic blank in the shell which blank extends at least to the plane of the edge of the shell flange and which has an area of reduced thickness aligned with the shell thread-receiving holes, which area is able to be pierced by the needle of a sewing machine as the button is attached to a garment.

BRIEF DESCRIPTION OF THE DRAWINGS

In the accompanying drawings which form part of the instant specification and which are to be read in conjunction therewith and in which like reference numerals are used to indicate like parts in the various views:

FIG. 1 is a sectional view of a metal button of the prior art attached to a fabric illustrating the problem of puckering.

FIG. 2 is a sectional view of another form of metal button of the prior art in position on a fabric and illustrating the problem of puckering.

FIG. 3 is a top plan view of the shell of my metal button assembly.

FIG. 4 is a sectional view of the shell illustrated in FIG. 3 taken along the line 4—4 of FIG. 3.

FIG. 5 is a top plan view of the blank of my improved metal button assembly.

FIG. 6 is a sectional view of the blank of my metal button assembly taken along the line 6—6 of FIG. 5.

FIG. 7 is a sectional view of my improved metal button assembly after it has been attached to a fabric.

FIG. 8 is a sectional view of an alternate form of my improved metal button assembly.

DESCRIPTION OF THE PRIOR ART

Referring now to FIG. 1, one form of metal button 10 of the prior art is formed of sheet metal to provide an inwardly directed flange 12 giving some thickness to the structure and providing it with a measure of strength. The button 10 has a generally convex outer surface, the central region of which is provided with two or more thread-receiving holes such as the holes 14 and 16. The button 10 is adapted to be attached to fabric 18 or the like by thread 20 which is driven through the holes 14 and 16 and through the fabric 18 by the needle of an automatic sewing machine which draws the fabric 18 relatively tightly up into engagement with the inner surface of the button 10. As a result of that operation, there is formed in the fabric 18 under the holes 14 and 16 an unsightly pucker 22 and the assembly is difficult to button.

Other forms of metal button have less convexity than the button 10. For example, as illustrated in FIG. 2, a relatively flat metal button 24 is provided with a peripheral flange 26 to afford the illusion of thickness. This button is provided with holes 28 and 30 through which thread 34 passes to secure the button to a fabric 32. As is the case with the button 10, attachment of the button 24 to the fabric 32 likewise results in the formation of a pucker 36 below the holes 28 and 30. While the pucker in this instance is not so pronounced as with the button 10, nevertheless it is undesirable. As will be apparent from the description hereinbelow, my invention eliminates puckers such as the pucker 22 and the pucker 36 resulting from attachment of the button to a fabric, whether the shell has a relatively high degree of convexity or whether it is flat.

DESCRIPTION OF THE PREFERRED EMBODIMENT

Referring now to FIGS. 3 to 7, one form of my improved metal button assembly includes a shell 38 formed from sheet metal or the like. I provide shell 38 with generally centrally located thread-receiving holes 44 and 46 and with a peripheral flange 40. While I have shown the shell 38 as having a flat top, it will readily be appreciated from the description given hereinbelow that the surface of the top of the shell 38 may provide any desired degree of convexity of concavity. Further in the form of shell illustrated in FIGS. 3 to 7, the flange 40 extends generally vertically and is provided with a blank retaining lip 42 at the lower edge thereof.

The form of my improved metal button assembly illustrated in FIGS. 3 to 7 includes a blank 48 made from any suitable synthetic resin such, for example, as polyvinyl chloride or the like. I form a recess 50 in the upper surface of the blank 48 and reduce the thickness of the blank in a central region 52 thereof to such an extent that it is relatively easily pierced by the needle of a sewing machine. The underside of the blank 48 is generally flat and the periphery thereof may be slightly curved to permit it to receive the lip 42.

After the shell 38 and the blank 48 have been formed in the manner described, the blank 48 is swaged into the shell with the upper surface thereof facing the undersurface of the shell 38.

In use of the form of my improved metal button assembly shown in FIGS. 3 to 7, a thread 58 is driven through the holes 44 and 46 through the reduced thickness portion 52 of the blank 48 and through the fabric 56 to attach the button to the fabric 56. While the central portion 52 is sufficiently thin that the needle of a sewing machine can pierce the region with relative ease, the overall blank 48 is sufficiently rigid that it will not be drawn upwardly into the shell under the action of the tension applied to the thread by the sewing machine. As has been pointed out hereinabove, the top of the shell 38 may be convex rather than flat, as indicated by the broken line 60 in FIG. 7. If desired the shell may be concave.

Referring now to FIG. 8, in an alternate form of my improved metal button assembly the shell 62, having thread-receiving holes 64 and 66, is provided with a peripheral flange 68 which is directed slightly inwardly. The blank 70 of this form of my button has a slightly outwardly directed peripheral side so that it will securely be held in the shell 62, without the need for a lip such as lip 42. In this form of my button, moreover, I provide the blank 70 with a boss 72 on the undersurface thereof and form the boss 72 with the region 74 of reduced thickness. This arrangement permits the main portion of the button to be spaced away from the surface of the fabric. As is the case with the form of my button illustrated in FIGS. 3 to 7, no undesirable pucker results when this form of button is applied to a fabric. This is especially advantageous in buttons for outer garments or those made of heavy fabrics.

It will be seen that I have accomplished the objects of my invention. I have provided an improved metal button which overcomes the defects of metal buttons off the prior art. My button does away with unsightly puckers which result when buttons of the prior art are attached to a fabric. It reduces wear on the button-attaching thread. It is relatively inexpensive for the result achieved thereby.

It will be unerstood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A button assembly including in combination a first shell formed of metal having a top portion provided with thread receiving openings and having a depending peripheral sidewall portion, a second shell formed of a semi-rigid material having a bottom and having an up-standing peripheral sidewall portion, the sidewall portions of the two shell being so constructed that the second shell may be snapped into the first shell to form a hollow button assembly, the bottom of the second shell comprising a generally flat needle-pieceable portion registering with said openings and abutting material to which the button assembly is to be sewn, the second shell having sufficient rigidity to prevent puckering of such material in the vicinity of its threaded attachment to the button assembly.

2. A button assembly as in claim 1 wherein the bottom of the second shell is generally flat.

3. A button assembly as in claim 1 wherein the bottom of the second shell comprises a peripheral portion and wherein the needle-pierceable portion of the bottom of the second shell protrudes from the peripheral portion to space the peripheral portion from the material to which the button assembly is to be sewn.

* * * * *